US005909794A

United States Patent [19]

Molbak et al.

[11] Patent Number: 5,909,794

[45] **Date of Patent: *Jun. 8, 1999**

[54] DONATION TRANSACTION METHOD AND APPARATUS

[75] Inventors: Jens H. Molbak, Bellevue; Carol Lewis, Seattle; Johanna Carlson, New Castle; Michael Doran, Mukilteo, all of Wash.

[73] Assignee: Coinstar, Inc., Bellevue, Wash.

[ * ] Notice: This patent is subject to a terminal disclaimer.

[21] Appl. No.: 08/852,328

[22] Filed: May 7, 1997

Related U.S. Application Data

[63] Continuation-in-part of application No. 08/689,926, Aug. 12, 1996, and application No. 08/834,952, Apr. 7, 1997, Pat. No. 5,799,767, which is a continuation of application No. 08/237,486, May 3, 1994, Pat. No. 5,620,079, said application No. 08/689,926, is a continuation of application No. 08/255,539, Jun. 6, 1994, Pat. No. 5,564,546, which is a continuation of application No. 07/940,931, Sep. 4, 1992, abandoned.

[51] Int. Cl.[6] ..... G07D 3/16

[52] U.S. Cl. ..... 194/216; 235/380

[58] Field of Search ..... 194/216, 217, 194/205, 208, 209; 235/380

[56] References Cited

U.S. PATENT DOCUMENTS

| | | | |
|---|---|---|---|
| 446,303 | 2/1891 | Thompson . | |
| 2,865,561 | 12/1958 | Rosapepe | 232/7 |
| 3,065,467 | 11/1962 | Prevost | 346/22 |
| 3,132,654 | 5/1964 | Adams . | |
| 3,173,742 | 3/1965 | Simjian | 346/22 |
| 3,603,327 | 9/1971 | Buchholz et al. . | |
| 3,815,717 | 6/1974 | Arseneau . | |
| 4,036,242 | 7/1977 | Breitenstein et al. . | |
| 4,058,954 | 11/1977 | Asami | 53/54 |
| 4,059,122 | 11/1977 | Kinoshita . | |
| 4,099,722 | 7/1978 | Rodesch et al. | 273/143 R |
| 4,100,925 | 7/1978 | Fukunaga . | |
| 4,106,610 | 8/1978 | Heiman . | |
| 4,167,949 | 9/1979 | Hashimoto et al. . | |
| 4,228,811 | 10/1980 | Tanaka et al. . | |
| 4,249,552 | 2/1981 | Margolin . | |

(List continued on next page.)

FOREIGN PATENT DOCUMENTS

| | | | |
|---|---|---|---|
| 2060630 | 7/1992 | Canada | G06F 15/24 |
| 2067987 | 7/1992 | Canada | G06F 15/21 |
| 25 28 735 | 4/1976 | Germany | B60K 17/10 |
| 30 21 327 | 12/1981 | Germany | G07D 3/06 |
| 3-92994 | 4/1991 | Japan | G07D 9/00 |
| 2223872 | 4/1990 | United Kingdom | 194/217 |
| US93/07846 | 4/1994 | WIPO | G06F 15/16 |

OTHER PUBLICATIONS

Hamilton, "Turning Cans Into Cold Cash", *The Washington Post,* Jul. 2, 1991, pp. D1 and D4, 194–209.

Reis Eurosystems Geldbearbeitungssysteme, "Test — Programme CS 3110 Selectronic coin sorting and counting machine", Jul. 1992, pp. 1–3.

Reis Eurosystems, "Operating Instructions CS 3110 Selectronic Coin Sorting and Counting Machine with Central Sensor", Jul. 1992, pp. 1–12, I–IV.

"Slide Changing Apparatus With Slide Jam Protection", Research Disclosure 30509, Sep. 1989.

F. Zimmerman & Co., "Reference Manual Contovit/Sortovit, Perconta Money Counting and Sorting Systems", Aug. 1995, pp. I–III, 1–31 and three pages of specifications.

"Turning Cans into Cold Cash," The Washington Post, pp. D1 and D4, 194–209, Jul. 2, 1991.

*Primary Examiner*—F. J. Bartuska
*Attorney, Agent, or Firm*—Sheridan Ross P.C.

[57] ABSTRACT

A donation transaction apparatus and method for facilitating donations to charitable organizations is provided. The apparatus is configured to receive coins or, in some embodiments, cash or funds transfer authorization or credit charges, and preferably dispenses a donation receipt to the user which the user may use to prepare or document income tax returns. Preferably, the user is able to select among a plurality of charitable organizations to receive the donation.

14 Claims, 8 Drawing Sheets

U.S. PATENT DOCUMENTS

| | | | |
|---|---|---|---|
| 4,266,121 | 5/1981 | Hirose | 235/381 |
| 4,356,829 | 11/1982 | Furuya . | |
| 4,360,034 | 11/1982 | Davila et al. . | |
| 4,369,800 | 1/1983 | Watanabe et al. . | |
| 4,380,316 | 4/1983 | Glinka et al. | 232/16 |
| 4,383,540 | 5/1983 | De Meyer et al. . | |
| 4,398,550 | 8/1983 | Shireman . | |
| 4,434,359 | 2/1984 | Watanabe | 235/379 |
| 4,503,963 | 3/1985 | Steiner . | |
| 4,558,711 | 12/1985 | Yoshiaki et al. . | |
| 4,598,378 | 7/1986 | Giacomo | 364/479 |
| 4,611,205 | 9/1986 | Eglise | 340/825.35 |
| 4,622,456 | 11/1986 | Naruto et al. | 235/379 |
| 4,706,577 | 11/1987 | Jones | 109/59 T |
| 4,716,799 | 1/1988 | Hartmann | 83/42 |
| 4,723,212 | 2/1988 | Mindrum et al. | 364/401 |
| 4,753,625 | 6/1988 | Okada | 453/32 |
| 4,883,158 | 11/1989 | Kobayashi et al. | 194/217 |
| 4,910,672 | 3/1990 | Off et al. | 364/405 |
| 4,921,463 | 5/1990 | Primdahl et al. | 453/3 |
| 4,936,436 | 6/1990 | Keltner | 194/318 |
| 4,953,086 | 8/1990 | Fukatsu | 364/408 |
| 4,978,322 | 12/1990 | Paulsen | 453/57 |
| 4,995,848 | 2/1991 | Goh | 453/3 |
| 4,997,406 | 3/1991 | Horiguchi et al. | 453/57 |
| 5,021,967 | 6/1991 | Smith | 364/479 |
| 5,025,139 | 6/1991 | Halliburton, Jr. | 235/379 |
| 5,039,848 | 8/1991 | Stoken | 235/381 |
| 5,091,713 | 2/1992 | Horne et al. | 340/541 |
| 5,098,339 | 3/1992 | Dabrowski | 453/30 |
| 5,173,851 | 12/1992 | Off et al. | 364/401 |
| 5,219,059 | 6/1993 | Furuya et al. | 194/200 |
| 5,226,519 | 7/1993 | De Woolfson | 194/209 |
| 5,299,673 | 4/1994 | Wu | 194/345 |
| 5,316,120 | 5/1994 | Ibarrola | 194/318 |
| 5,321,242 | 6/1994 | Heath, Jr. | 235/382 |
| 5,388,680 | 2/1995 | Hird et al. | 194/345 |
| 5,449,058 | 9/1995 | Kolter et al. | 194/344 |
| 5,506,393 | 4/1996 | Ziarno | 235/380 |
| 5,564,546 | 10/1996 | Molbak et al. | 194/216 |
| 5,620,079 | 4/1997 | Molbak | 194/217 |

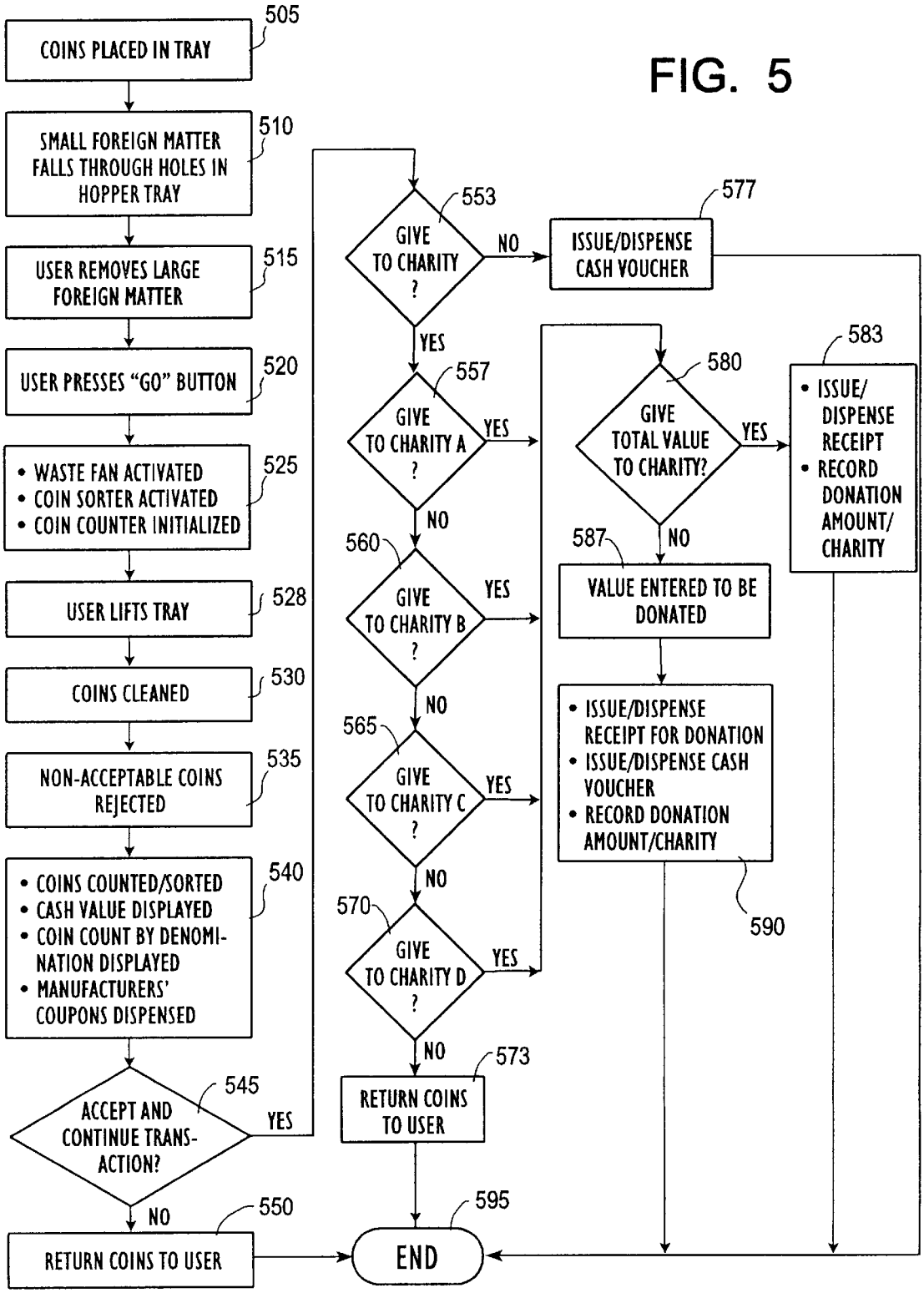
FIG. 5
505
COINS PLACED IN TRAY
510
SMALL FOREIGN MATTER FALLS THROUGH HOLES IN HOPPER TRAY
515
USER REMOVES LARGE FOREIGN MATTER
520
USER PRESSES "GO" BUTTON
525
• WASTE FAN ACTIVATED
• COIN SORTER ACTIVATED
• COIN COUNTER INITIALIZED
528
USER LIFTS TRAY
530
COINS CLEANED
535
NON-ACCEPTABLE COINS REJECTED
540
• COINS COUNTED/SORTED
• CASH VALUE DISPLAYED
• COIN COUNT BY DENOMINATION DISPLAYED
• MANUFACTURERS' COUPONS DISPENSED
545
ACCEPT AND CONTINUE TRANSACTION?
YES
NO
550
RETURN COINS TO USER
553
GIVE TO CHARITY ?
NO
YES
557
GIVE TO CHARITY A ?
YES
NO
560
GIVE TO CHARITY B ?
YES
NO
565
GIVE TO CHARITY C ?
YES
NO
570
GIVE TO CHARITY D ?
YES
NO
573
RETURN COINS TO USER
577
ISSUE/DISPENSE CASH VOUCHER
580
GIVE TOTAL VALUE TO CHARITY?
YES
NO
583
• ISSUE/DISPENSE RECEIPT
• RECORD DONATION AMOUNT/CHARITY
587
VALUE ENTERED TO BE DONATED
• ISSUE/DISPENSE RECEIPT FOR DONATION
• ISSUE/DISPENSE CASH VOUCHER
• RECORD DONATION AMOUNT/CHARITY
590
595
END

DONATION TRANSACTION METHOD AND APPARATUS

DONATION TRANSACTION METHOD AND APPARATUS

The present application is a continuation-in-part of Ser. No. 08/689,926 filed Aug. 12, 1996 for COIN COUNTER/SORTER AND COUPON/VOUCHER DISPENSING MACHINE AND METHOD, which is a continuation of Ser. No. 08/255,539, filed Jun. 6, 1994, now U.S. Pat. No. 5,564,546, which is a continuation of Ser. No. 07/940,931, filed Sep. 4, 1992, now abandoned, and the present application is also a continuation-in-part of Ser. No. 08/834,952 now U.S. Pat. No. 5,799,767, filed Apr. 7, 1997, which is a continuation of Ser. No. 08/237,486 filed May 3, 1994, now U.S. Pat. No. 5,620,079, all of which are incorporated herein by reference.

The present application relates to a method and apparatus for a donation transaction and in particular to an apparatus and method which facilitates a monetary donation to one or more charitable organizations and provides a donation receipt therefor.

BACKGROUND INFORMATION

A number of organizations exist for the purpose of charitable and/or non-profit functions, including organizations which qualify as charitable organizations under U.S. Internal Revenue Service Regulation 501(c)(3). Not uncommonly, such organizations find that there are a number of costs associated with receiving and handling donations. One cost involves the labor or man-power costs associated with soliciting and/or receiving such donations. Many charitable organizations employ or hire individuals or organizations for the purpose of soliciting funds, attracting potential donors and the like. Because there are often costs associated with such employees or organizations (including wages, salaries or commissions and/or costs of advertising services or materials, typically a certain portion of the funds received or collected by a charitable organization, which might otherwise be available for the organizations' charitable functions, must instead be expended for costs associated with attracting or receiving donations.

Accordingly, it would be useful to provide an apparatus and method for donation transactions which reduces man-power requirements and/or costs associated with at least some donation transactions.

Another cost typically associated with or born by charitable organizations is the cost of handling the donated funds. In many situations, donations take the form of coins, currency, and/or negotiable instruments such as personal checks. Partially in situations where the charitable organization receives a relatively large number of donations in relatively small amounts, the costs associated with handling such coins, cash or checks, (such as costs of counting and/or rolling or packaging coins, counting cash and/or checks, and depositing these items in a financial institution) further depletes funds of the charitable organization.

Accordingly, it would be useful to provide an apparatus or method which reduces the cost, to charitable organizations, associated with handling and/or bank deposits for donation transactions.

Yet another cost sometimes associated with charitable transactions is the cost associated with providing receipts to donors, particularly receipts of a type that may be used by donors in calculating taxes or completing or documenting tax returns.

Accordingly, it would be useful to provide an apparatus or method which reduces the cost, to charitable organizations, associated with providing donation receipts for donation transactions.

Donors to charitable organizations are sometimes solicited for donations in situations where the donors are presented with a single choice: to donate or not to donate to a single, particular charitable organization. Accordingly, it would be useful to provide an apparatus and method in which potential donors are presented with a number of different options for the recipient of their donation.

In a number of situations, a person wishing to make a donation to a particular charitable institution is required to either be in possession of a donation form and/or an address for other information so that the donation may be transmitted to the correct recipient. Also, donors often must bear the cost of postage or telephone calls. This situation is particularly problematic for donors who may have relocated, temporally or permanently, to a location far removed from the desired charitable organization. Accordingly, it would be useful to provide a method or apparatus to permit a donor, even though in a distant geographic location, to readily donate to a desired organization without the need to know the organization's address, without the need to possess a donation form and without the need to expend funds on postage and/or telephone calls to make the donation.

SUMMARY OF THE INVENTION

According to one embodiment of the invention, an apparatus is provided which includes a device for receiving, or authorizing the transfer of, funds from the donor and which outputs information regarding the donations, preferably in such a way to facilitate automatic deposit of funds in the recipient's bank account (such as by electronic funds transfer). In one embodiment, a device for receiving funds includes a coin counting apparatus, preferably positioned in a location where donors commonly have or bring coins, such as a retail location. Preferably, the apparatus allows the user to indicate any of a number charitable organizations as the intended recipient. In one embodiment, the user is presented with one or more lists or displays of organizations to receive the gift.

Preferably, when the user selects the charitable organization and makes the gift, the apparatus will provide the donor with a receipt, preferably of a form which may be used in the preparation of, or be used to document, a tax return.

Preferably, the apparatus outputs information to facilitate deposit of the donated funds in the appropriate charities' bank accounts. In one embodiment, information from multiple field units is transmitted to a central processing facility, preferably electronically, which, at intervals, deposits the collected funds in bank accounts of the charitable organizations designated by the donors, preferably automatically and preferably by electronic funds transfer.

BRIEF DESCRIPTION OF THE DRAWINGS

FIG. 5 is a flow chart depicting a donation transaction process according to an embodiment of the present invention;

DETAILED DESCRIPTION OF THE PREFERRED EMBODIMENT

Figure 1:
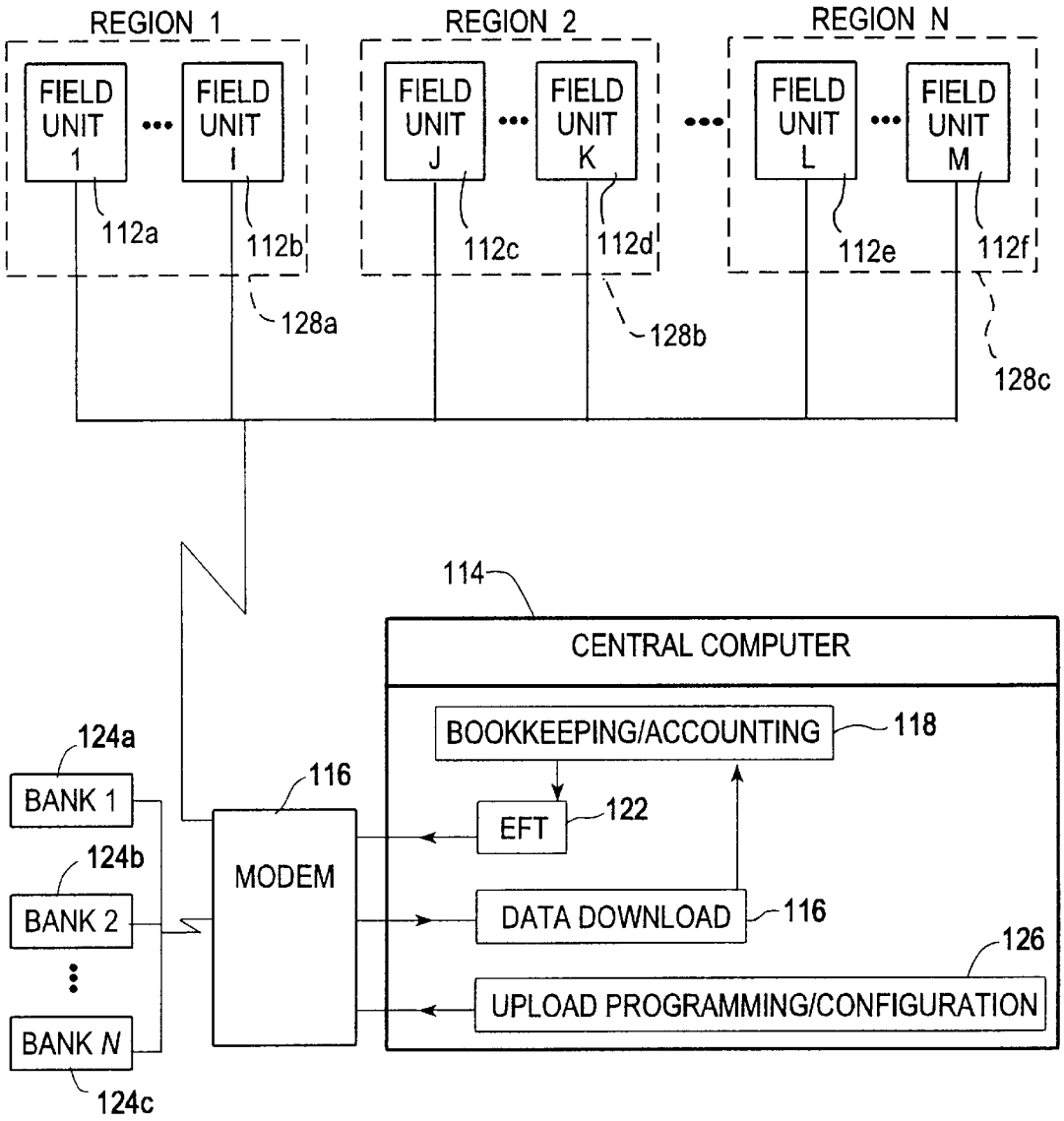
FIG. 1 is a block diagram depicting a donation transaction system according to an embodiment of the present invention.

As depicted in FIG. 1, one embodiment of the present invention involves coupling a plurality of field units 112*a*–112*f* to a central computer 114 by a communication device such as a modem 116. Devices which can be used as field units are described below. The central computer 114 may be any of a number of computers including personal computers, computers based on Intel 486 and/or Pentium® processors or workstation—type computers. In some embodiments two or more coupled computers may be used for this purpose.

In one embodiment, periodically, such as once per day, the central computer 114 will contact each of the field units e.g. over telephone lines, wide area network links, cellular or satellite communication links and the like. The central computer 114 will than execute a data download routine 116, obtaining from each field unit 112*a*–112*f* information indicating the amount of funds donated and the identity of the charitable organization receiving each amount of funds.

When this data is downloaded from field units 112*a*–112*f*, it is provided to bookkeeping or accounting routines 118. In one embodiment, the bookkeeping and accounting routines also serve to reconcile the amount of funds indicated as having been donated with the amounts which are deposited in banks from the field units (such as coins or cash received in the field units).

In one embodiment, the bookkeeping or accounting procedures 118 also determine the amount of the donated funds which will be retained as a service charge. The service charge can be based on any of a number of factors. In one embodiment, a constant or flat service charge, (such as a fixed percentage of donations) is applied to all donations and all charitable organizations. A number of other service fee structures are also possible. In one embodiment, the fee may be based on volume, such as charging a lower fee for higher-volume charitable organizations. In one embodiment, a fee may be related to a type or amount of services provided to the charitable organization, such as by retaining a larger service fee for those organizations which are more prominently displayed or more prominently advertised by the field units 112*a*–112*f*. In one embodiment, service charges may vary at different times such as for providing a lower service charge for particular or traditional charity "drives" (such charging different fees at different charitable seasons e.g. Christmas, Halloween, etc.) for various organizations.

Periodically, such as monthly, quarterly, etc., the accumulated amounts indicated as having been donated to particular charitable organizations, less service charges, are deposited in the bank accounts of those organizations, preferably by an electronic funds transfer procedure 122 which may communicate with the appropriate banks 124*a, b, c,* e.g. via a modem 116.

As described below, in one embodiment each field unit 112*a*–112*f* can display a variety of options for donors, such as by displaying a number of different charitable organizations to which the donor may give. In one embodiment, different field units may be configured to provide different types of displays such as listing and/or featuring different charitable organizations, providing different disclosures or options or the like. It is anticipated that, commonly, such different field units options will be geographically based (such as featuring certain local charitable organizations in different geographical areas and/or modifying disclosure information and the like to comply with local laws). Furthermore, it is anticipated that the varying types of displays of different field units will change at different times, such as when particular charitable organizations have traditional seasonal drives or as different organizations choose to join or quit the described donation transaction system.

For these reasons, and in one embodiment, the central computer 114 is configured with the ability to upload programming or configuration information 126 e.g. via the modem 116 to the various field units 112*a*–112*f*. In one embodiment, the particular programming or configuration which is uploaded to various skilled units will be specific to the region or location 128*a, b, c* of the field units.

The field units 112 can have a number of different configurations and it is possible to provide a system in which different field units have different physical and/or software configurations.

Figure 2:
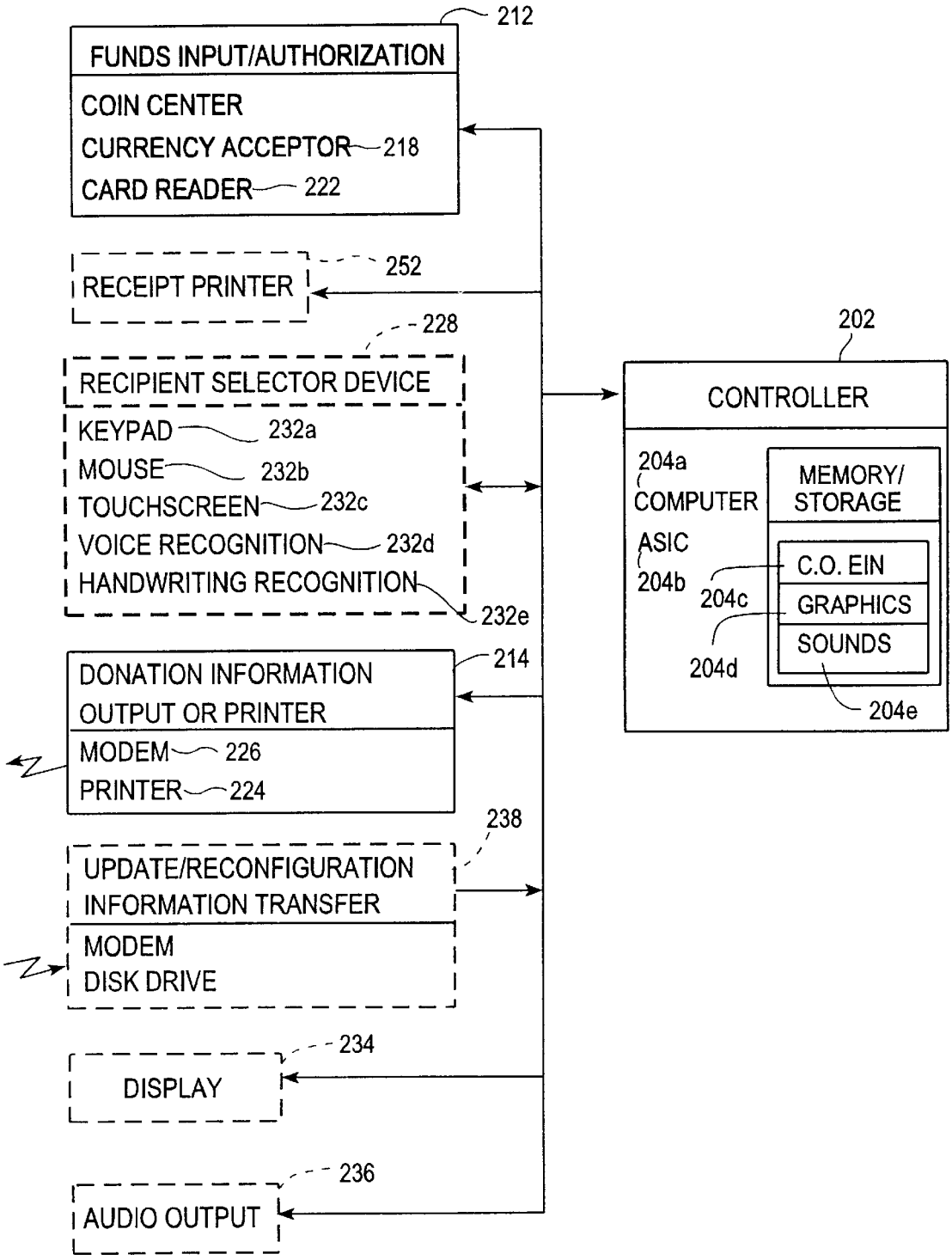
FIG. 2 is a block diagram depicting components of a donation transaction field unit according to an embodiment of the present invention.
Figure 3:
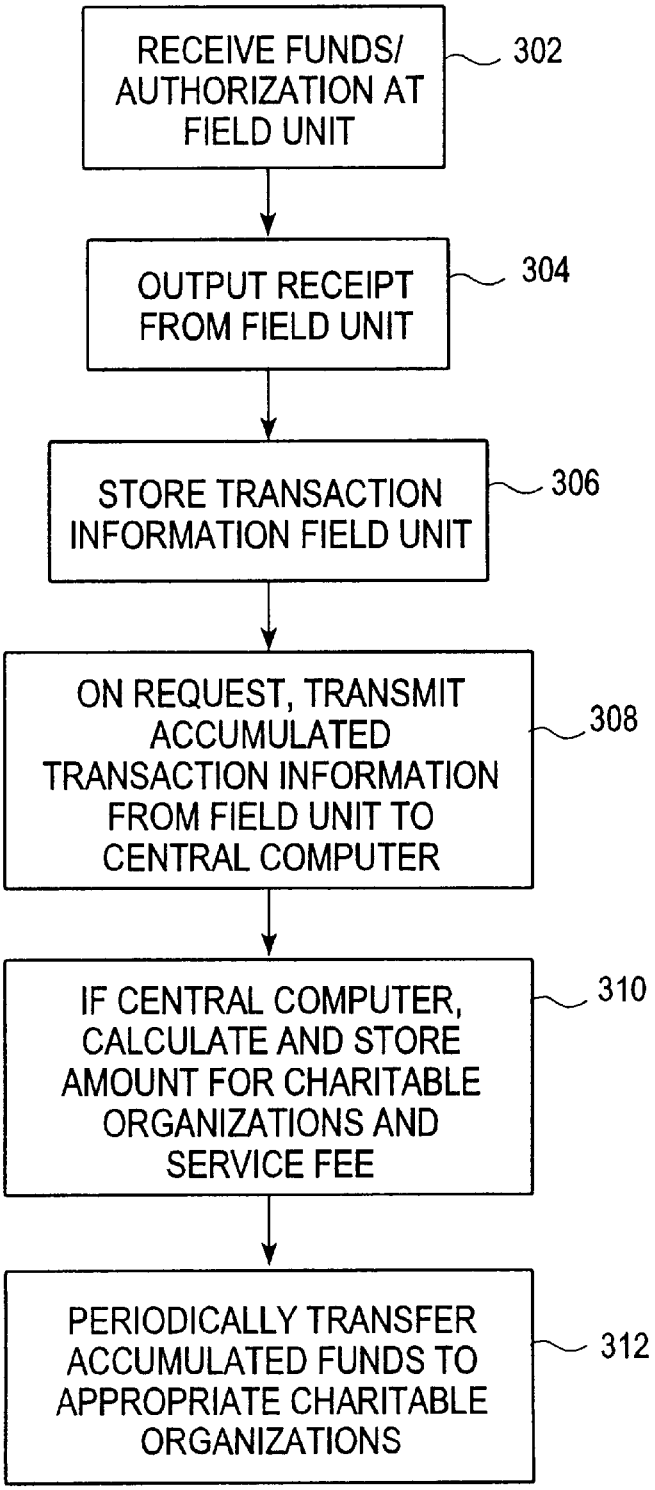
FIG. 3 is a flow chart depicting a donation transaction process according to an embodiment of the present invention.

As depicted in FIG. 2, in one embodiment a field unit includes a controller 202, which may be a computer such as a 486 and/or Pentium-based computer, 204*a* or may be implemented and/or use an application specific integrated circuit (ASIC) 204*b*. In the depicted embodiment, a controller is coupled to a memory or storage unit 206 such as a hard disk storage unit, random access memory (RAM) flash memory, read-only memory (ROM) and the like. The memory 206 may be used for storing text or other data associated with charitable organizations (such as name, employer identification number (EIM) or recipient identification code (RIC) 208*a,* graphics, such as logos or other displays (including animated or motion picture displays) 208*b* and/or sound files 208*c*. Coupled to the controller 202 are peripherals such as a peripheral for imputing or authorizing transfer of funds 212 and an information output device or printer 214.

Figure 6A:
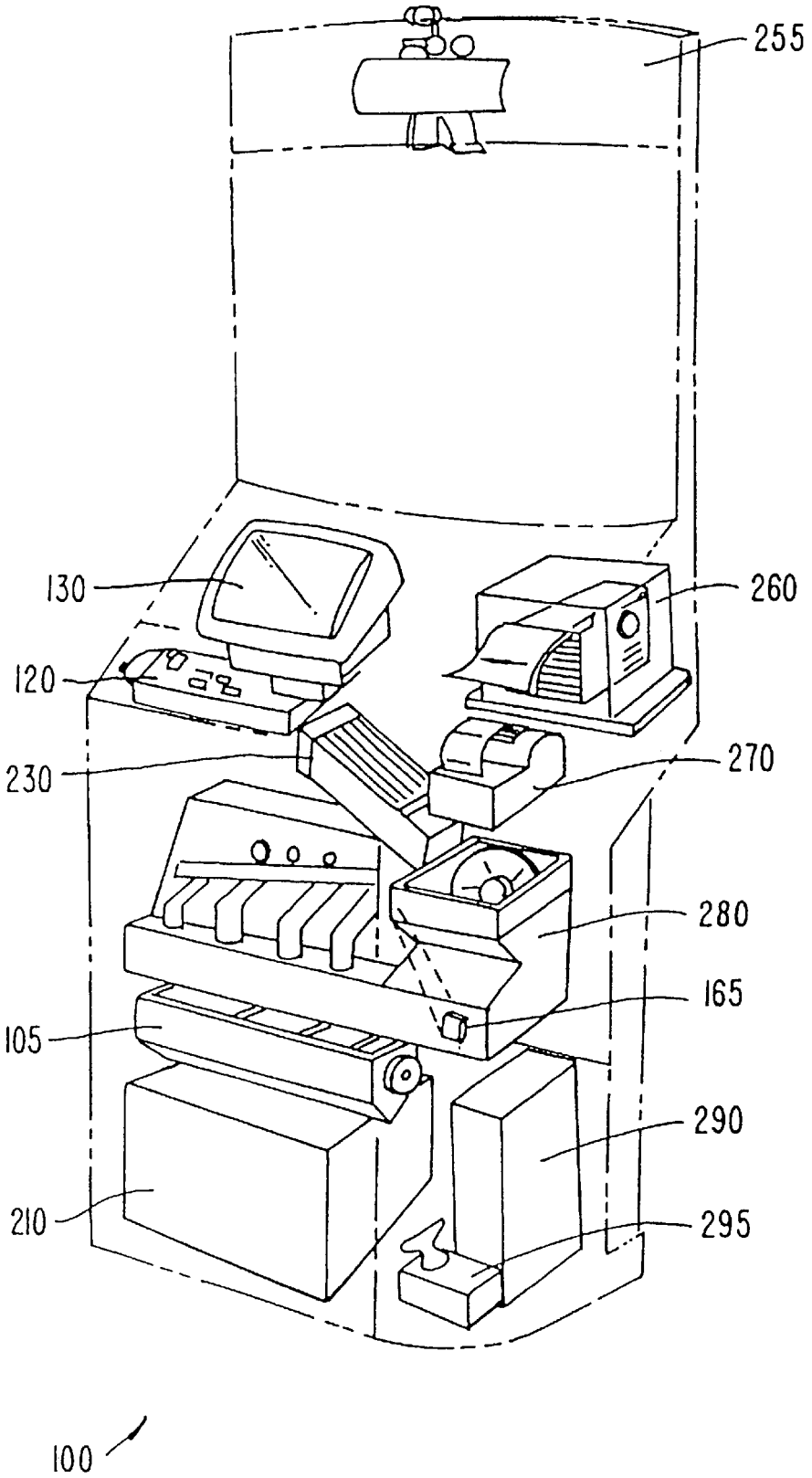
FIGS. 6A and 6B depict coin counting devices which may be used in conjunction with embodiments of the present invention.

In one embodiment the funds input device 212 includes a coin counter such as that described in U.S. Pat. No. 5,620,079, supra, illustrated in FIG. 6. It is believed that a coin counter is particularly amenable to the present invention since a number of charitable organizations have found that donations of coins are particularly successful. The internal layout of a coin counting kiosk 100, which may be used in conjunction with an embodiment of the present invention, is shown in FIG. 6. The coin storage area 210 holds the coins after the transaction has been completed. Area 210 can either be separated into large capacity bins to hold each denomination, or into ready to use coin trays. When the storage area is close to capacity, an indicator 255 on the outside of the kiosk 100 notifies store personnel to empty the storage area 210.

The outside of a waste management system 230 is visible in this diagram. Liquids fall through the porous, grooved bottom plate of system 230 while lint and other fine materials are blown away by a small fan located in the chute. Liquids are collected in a waste receptacle. At the end of system 230, the coins are funneled into the coin counter and sorter 280. If desired, this may be a commercially available sorter. The counter accepts mixed coins and is able to detect foreign coins and slugs. Rejected coins are returned to the user through chute 165.

In one embodiment of the kiosk, two different printers are used. Printer 270 is used to print the donation receipts and, in some embodiments, cash vouchers and store coupons. Besides outputting the amount, the printer may also output other information such as store name, transaction number, bar codes, etc in order to make counterfeiting difficult. Special papers and inks can also be used to discourage counterfeiting. In one embodiment, a separate printer 295 makes a continuous record of each transaction. In a second embodiment printer 270 serves a double function. Besides printing the vouchers, upon command by store personnel this printer prints out all of the pertinent transactional information. CPU 290 also stores this information.

In one embodiment, VGA screen 250 is a Super VGA monitor; CPU 290 is a 386, 486 or Pentium CPU. Warning light 255 warns store personnel when either printer is low on paper, the sheet feeder is low on paper or there has been a malfunction.

Other, more advanced, coin counting devices can also be used such as those described in U.S. patent applications 08/807,046 filed Feb. 24, 1997, PCT/US97/03136 filed Feb. 28, 1997 or 08/431,070 Apr. 27, 1995, all of which are incorporated herein by reference.

Other types of funds input devices or transfer authorization devices can be included in place of or in addition to coin counters, such as a currency or bill acceptor 218 or a card reader 222 for reading a number of types of cards (including credit cards, debit cards, retail "frequent" shopper cards, smart cards (which include a processor and/or memory chip) bank cards, employee identification cards or cards which are specifically for use in the present system.)

When donations have been made, the system also provides a facility for outputting information regarding the donations so that correct funds can be transferred or deposited to the charitable organizations. Although it is possible to provide a system in which the information is output visually such as on a printer 224, (permitting personnel to, thereafter, manually make the appropriate bank deposits), preferably, information is output from each field unit by a modem 226 to a central computer 114 as described above.

Figure 6B:
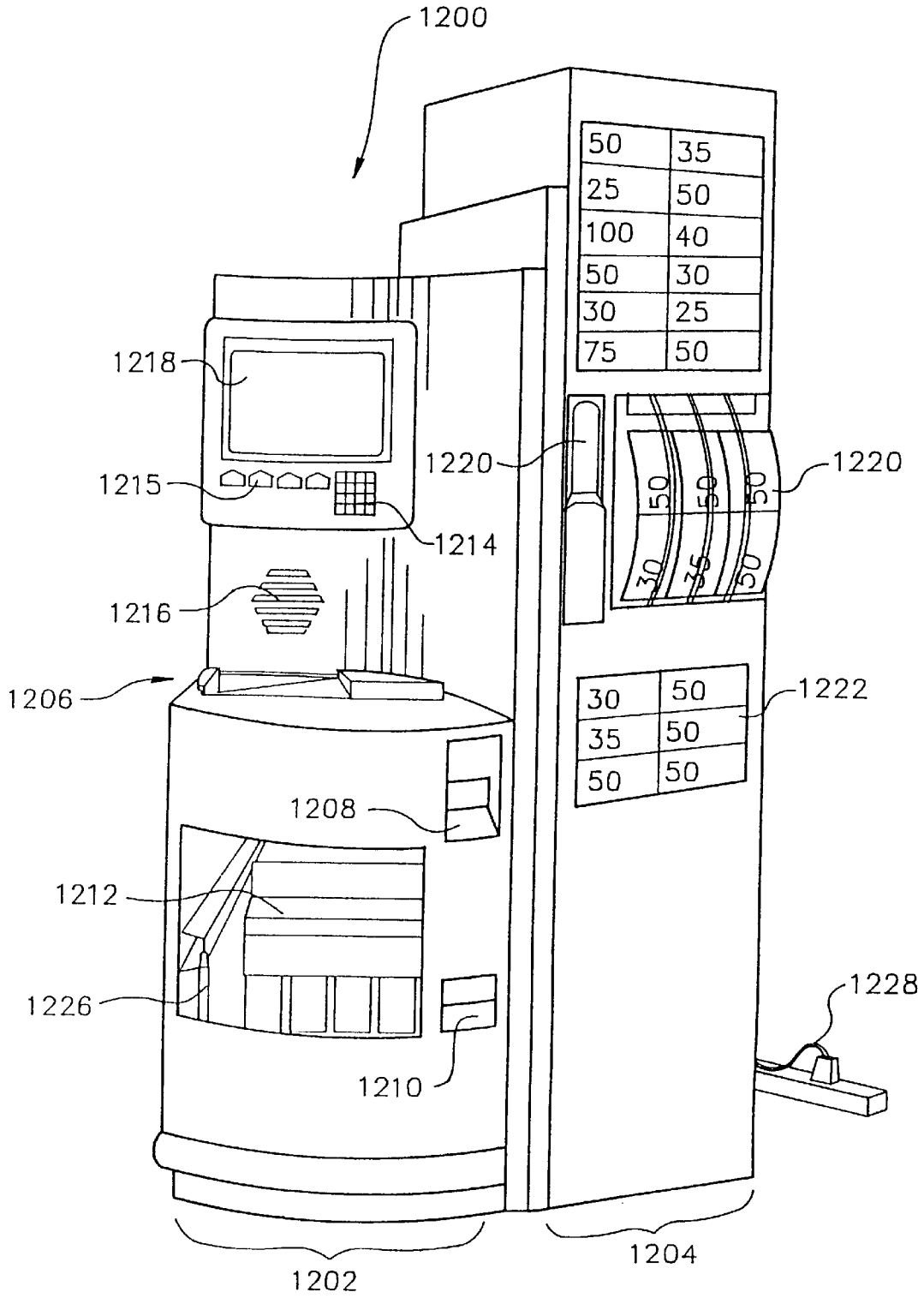

Another embodiment of a coin counter is depicted in FIG. 6B. In the embodiment of FIG. 6B, the device generally includes a coin counting/sorting portion 1202 and a coupon dispensing portion 1204. In one embodiment, these portions can operate independently in the sense that it is possible for the coin counting portion 1202 to be counting one customer's coins while the dispensing portion 1204 is dispensing coupons and/or vouchers to another customer. In the depicted embodiment, the coin counting portion 1202 includes an input tray or hopper 1206, a voucher dispensing slot 1208, a coin return slot 1210, a sorting/counting mechanism 1212, and customer I/O devices, including a keyboard 1214, additional keys 1215, a speaker 1216 and a video screen 1218. The coupon dispensing portion includes an activating device 1220 such as a button and coupon receptacle 1222. The apparatus 1200 can include various indicia, signs, displays, advertisement and the like on its external surfaces. In the depicted embodiment, portions of the counting/sorting mechanism are visible through a window 1226. A power cord 1228 provides power to the mechanism as described below.

Figure 7:
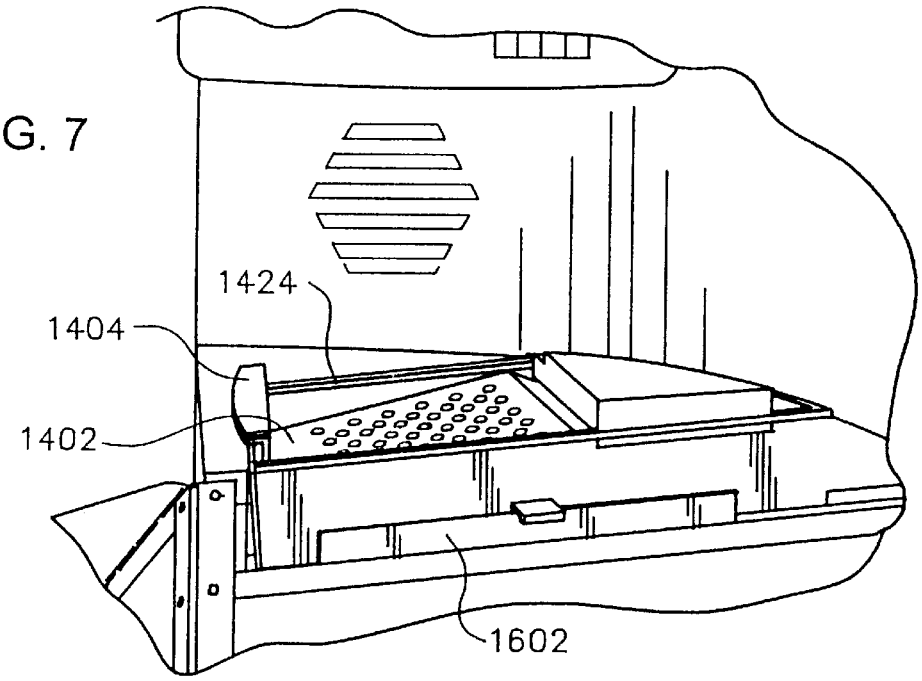
FIG. 7 depicts an input tray and trough of the device of FIG. 6.

FIG. 7 depicts a coin tray or hopper according to another embodiment of the invention. In the embodiment of FIG. 7, the bottom surface 1402 of the tray 1206, when the tray is in the rest or lowermost position is angled downward in a direction away from the transfer tray. In this way, even when the hopper 1402 is filled to the rim, the coins will not begin flowing into the transfer tray 1406 until the user begins lifting the tray, such as by lifting handles 1404. As the user lifts the hopper from the lowermost position 1408 to an upper position 1410, coins heaped up to the upper rim 1412 will be positioned higher than the pivot point or peak 1414. The first coins to reach a critical height above the peak 1414 will begin sliding and will eventually move over the peak 1414 and into the transfer tray 1406. The peak 1414 has an angle such that in general, as the tray is lifted, coins will travel over the peak 1414 in a single plane or layer, such that, in general, there will be substantially little or no overlap of one coin over another. As described more thoroughly below, this type of coin flow provides a number of advantages. It assists in the waste management system because it makes it possible to expose each coin individually to a magnetic system and/or blowing system without one of the coins blocking another coin from the waste management system. It also assists in preventing undesirable surges or large flows of coins into the transfer tray 1406 since the flow of coins is limited by the fact that, generally, only a single layer of coins travels over the peak 1414 at a given time. The system is also useful because it is self-clearing in the sense that if a large coin flow is experienced, the user can allow the tray to move downward towards its lowermost position 1418 which will cause coins to move in a direction away from the tray 1406, thus clearing the entrance to the transfer tray 1406. Preferably, the bottom of the tray 1402 is at an angle with respect to horizontal, between about 10° and about 15°, preferably between about 11° and about 12° and is more preferably at an angle of about 11.56°. The initial downward slope of the transfer tray is inclined with respect to horizontal, at an angle of between about 25° and 35°, preferably between about 28° and about 31° and more preferably at an angle of between about 30°. Thus, the angle 1422 between the bottom surface of the coin tray and the initial slope of the transfer tray is between about 135° and 140°, preferably about 138°.

In one embodiment, it has been found useful to provide a material to fill the crack 1424 around the edge of the coin tray. Providing this material has been found useful in preventing coins from falling into the crack and preventing pinching of user's fingers. In one embodiment, a stiff-looped material such as that sold under the tradename VelcroÔ (preferably, using only the loop material and not the hook material) has been found useful, although other materials such as felt, rubber, plastic and the like may be used.

Figure 8:
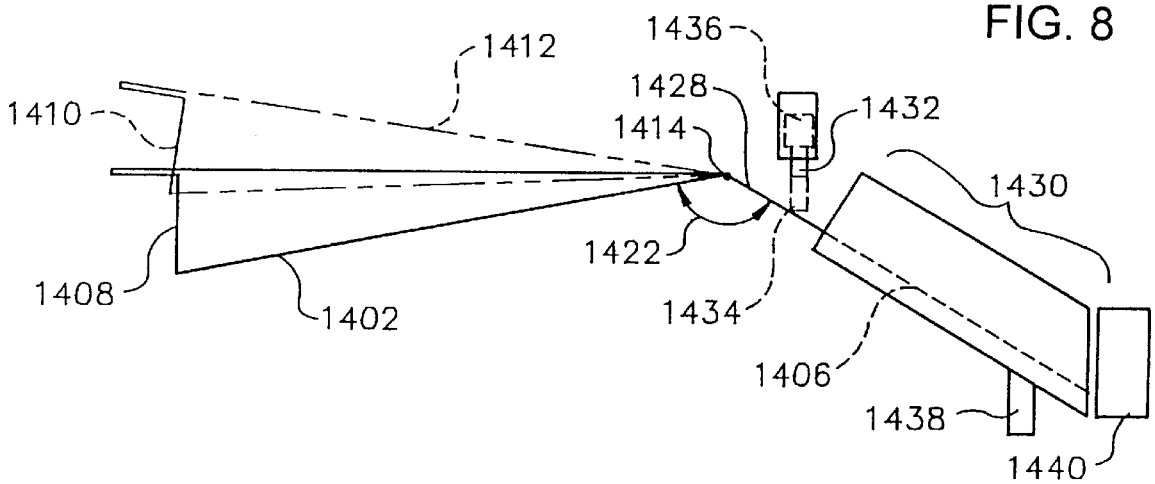
FIG. 8 is an elevational view of an input tray and trough which can be used in conjunction with embodiments of the present invention.

As shown in FIG. 8, the transfer tray 1406 includes an initial sloped portion 1428 and a downstream portion 1430. Preferably, the initial sloped portion 1428 as well as the bottom surface 1402 of the coin tray 1402, is provided with a number of perforations useful in the waste management system as described more thoroughly below. A gate is positioned over the initial portion 1428 and is movable from an upper open position 1432 to a lowered or closed position 1434. In one embodiment, the gate movement is achieved by a controllable solenoid 1436, controlled by the control and I/O system 1308, as described more thoroughly below. The open gate 1432 defines a slot through which the coins, after passing over the peak 1414 must pass. This slot is closed by the gate when it moves to the lower position 1434. Preferably, the gate remains in the lower position 1434 until the user initiates the counting/sorting process (e.g., by pushing the start button) in order to prevent entry of foreign material into the counting/sorting system during idle periods. In some embodiments, the gate is moved to the closed position in response to a jam or other malfunction of the counting/sorting mechanism. The size of the slot defined by the gate also assists in preventing undesirable flow or surge of coins by preventing the passage of a flow of coins greater than a predetermined thickness such as greater than a single layer or plane of coins.

The lower portion 1430 of the transfer tray has a lower surface 1406 having a plurality of grooves running lengthwise. This allows the coins to ride along the peaks while liquids or other wastes flow or travel down the valleys 820.

The perforations in the lower part of the transfer tray 1430 and the funnel and spout 1438 form part of the waste control system. The perforations in the upper portion of the transfer tray 1428 and the coin tray or hopper 1206 also are part of the waste control system since these perforations allow dense waste material with a size smaller than the perforations to fall through the perforations and thus to be separated from the coins. Materials falling through these perforations and the material output from the spout 1438 are collected in a waste tray.

Although it is possible to provide a system in which donations to only a single charitable organization are permitted at each field unit 112*a*–112*f* (or throughout the system), preferably one or more of the field units provide an ability for the donor to select the recipient of the gift 228. Accordingly, in the depicted embodiment, an input device is provided to permit recipient selection such as a keypad having one or more keys or buttons, 232*a* a pointing device such as a mouse 232*b,* trackball, joystick and the like, a touch screen input device 232*c,* a voice recognition device 232*d,* handwriting recognition device 232*e* and the like.

Preferably, the user is able to designate a particular recipient by entering a recipient identification code RIC. The RIC may have any of a number of different formats including letters, numbers or combinations thereof. In one embodiment the selection device 228 includes a numeric keypad and the RIC is a numeric code such as a 4-digit code. Preferably, a code is assigned to a particular charitable organization and used consistently throughout the system, regardless of the region 128*a,* 128*b,* 128*c*. In this way, a person using a field unit in one region 112*a* can easily make a donation to a charitable organization which resides or is primarily associated with a different geographic region 128*c,* without knowing a address, etc. of the recipient, but merely knowing the 4-digit RIC.

In one embodiment, the apparatus 112 may be provided with a display such as a printed display or booklet and/or a video display 234 for listing the various charitable organizations to which the user may make a gift. In one embodiment, the display 234 may be configured or controlled so as to provide greater prominence (or time) to the display of some organizations than that of others. In one embodiment, the user is initially presented with a display "featured organization" of a relatively small number, such as nine, featured charitable organizations among which the donor may select, preferably with an option to choose to see a longer list containing other charitable organizations, if desired. The system may also feature or provide additional prominence to certain charitable organizations by providing distinctive display features associated with that organization, such as colors, animation, logos and the like and/or may output audio 236 associated with one or more charitable organizations to be output either before or after the donor has made a selection of the charitable organization.

As noted above, in some embodiments it is desirable to provide a procedure to permit updating or reconfiguring the software for controlling the field units and accordingly, in one embodiment, an update/reconfiguration transfer device 238 is provided. Although it is possible to use a device such as a disk drive 242, preferably, the system includes a modem 244 for receiving information from a remote site, (which may be the same modem 226 used for outputting information).

According to one embodiment of the invention, the system operates by receiving funds, or receiving an authorization to transfer funds, at a field unit 302. Preferably the field unit outputs a donation receipt 304 of a type which may be used for preparing, documenting or supporting a tax return. In one embodiment, a donation receipt includes the date, the amount of the transaction and the federal employer identification number of the charitable organization.

Preferably, the receipt is configured in such a manner that it is not mistaken for a voucher (i.e. an item which can be exchanged for goods, services or cash). This may be achieved in a number of fashions such as using different type faces, colors, paper and the like for donation receipts (as opposed to vouchers) and/or including a notice on the donation receipt that it is not to be exchanged for cash.

Information about the donation transaction is stored in the field unit 306 such as in memory or a storage device. At intervals, such as daily, information about all donation transactions is transmitted to a central facility such as a central computer 114. In one embodiment, the central computer is configured to, preferably automatically, couple to each field unit, e.g. over telephone lines via a modem, and download the pertinent information 308. After obtaining the pertinent information, the central computer will calculate and store the indications of the amount of money donated to each charitable organization and the identity of the organization to which the amount was donated. The central computer will also preferably calculate the amount of the service charge (if any) to be associated with the donation transactions. Although service charges may be calculated and assessed in various fashions, as noted above, it is anticipated that, in general, service charges for the present system will be comparable to or less than costs normally born by charitable organizations in connection with donations, at least partly because of the automation involved and the reduced need for labor or personnel costs 310.

At intervals, such as monthly, quarterly, etc., the accumulated amounts that were donated are transferred to the appropriate charitable organizations such as by an electronic funds transfer (EFT) process which is preferably done at least partly automatically 312, i.e. without the need for human intervention.

Figure 4:
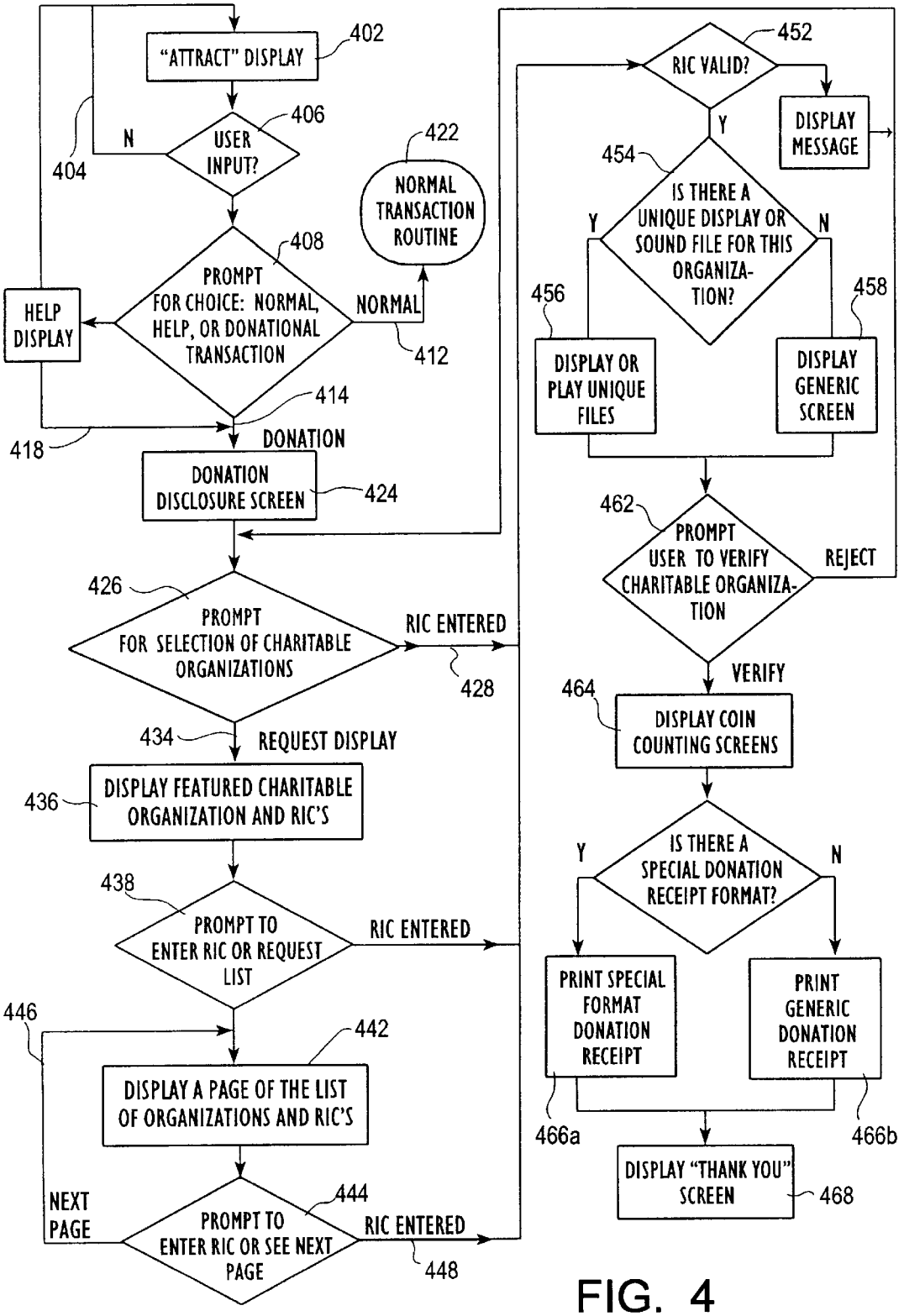
FIG. 4 is a flow chart depicting a donation transaction process according to an embodiment of the present invention.

FIG. 4 depicts a procedure for a donation transaction according to an embodiment of the present invention. In the depicted embodiment, initially, the apparatus displays, on the display screen 234, an "attract" display intended to attract the attention of users and provide information regarding the services being offered. Preferably, the attract display 402 includes information regarding donation transactions. In the depicted embodiment, the attract display will cycle or loop 404 until the user approaches and provides input (e.g. via a button or keyboard 232*a*) indicating a desire to use the apparatus 406. In response, the field unit 112 will display additional information, including prompting the user to input the users' choice whether to perform a normal coin transaction 412, perform a charitable or donation transaction 414 or request help 416.

In general, for any screen other than an attract screen, the user is presented with an option to request help or to return or back up to a previously displayed screen. Preferably, as each new screen is displayed, a timer is started so that, if no user input is received within a predetermined period (such as about thirty seconds) the system will return to the attract display 402.

If the user selects a normal transaction 412, a normal transaction process or routine is executed 422, similar to the normal transaction routine described in U.S. Pat. No. 5,620,079, supra.

If the user requests help, the help display which is presented on the display screen 234 preferably includes a prompt to use the button or keypad to request a charitable transaction or donation transaction 418.

If the user selects the option to perform a charitable or donation transaction (either directly from the prompt screen 408 or from the help display 418) a charitable disclosure screen 424 is displayed. The discloser screen may be used to provide further information about the donation transaction and may include any legal disclosures or notices which may be required in a particular jurisdiction.

The system displays a prompt 426 requesting user to input the RIC for a charitable organization or offering to provide a display of a partial list of charitable organizations.

If the user enters a four digit number via the keypad 232*a*, the procedure 428 progresses to a validation step 432.

If the user requests a display of charitable organizations, the system initially displays the "featured" charitable organizations 434, 436 as described above. In the depicted embodiment, the charitable organizations listed on the featured organization screen includes the four digit RIC for each charitable organization and the user is prompted to enter the RIC for the selected charitable organization or to request a more extensive list 438. If the user enters a four digit value, validation procedures are performed 432.

If the user requests a display of additional charitable organizations, a first page of a list screen showing numerous potential charitable organizations is displayed 442. The user is prompted to either enter the displayed RIC for a selected organization or to request the next page of the charitable organization list 444. This procedure loops 446 until the user enters the four digit RIC 448 and the system then proceeds with a validation process 432.

During the validation 432, the numbers entered by the user are compared to a list of valid RICs (e.g. stored in memory). If the number entered does not correspond to a valid RIC or a known charitable organization, a message to this effect is displayed 452 and the process returns to prompting the user for selection of a charitable organization 426. If a valid RIC has been entered, the system determines whether there is a special output (such as a special display screen or sound file) associated with the selected charitable organization 454 and, if so, this special output is displayed or played 456. Otherwise, a generic display is provided identifying the selected charitable organization 458.

The user is prompted to verify that the correct or intended charitable organization was selected 462. If not, the system returns to prompt the user for selection of a charitable organization 426. Otherwise, the system begins normal coin acceptance or counting procedures showing display screens that, for example, indicate the status of the coin counting procedure and the like 464. Typically, when the system senses that all input coins have been processed, the user is requested to verify that the transaction has come to an end or to indicate that there are additional coins or items to be inputted or counted.

At the end of the transaction, the system outputs a printed donation receipt using the receipt printer 252 and displays on a display screen 234, a message reminding the user to take the receipt 466. Before printing the donation receipt, the system will determine (e.g. via a look up table) whether a unique or special display or print format is to be used in connection with the donation receipt, such as by printing a logo for the charitable organization, a message related to the charitable organization or the like. Otherwise, a generic donation receipt format is used. In either case, the donation receipt preferably includes at least the date, amount and charitable organization tax identification number. The system then displays a screen thanking the donor and, displaying the logo or other graphic associated with the charitable organization, if such is available 468.

In one embodiment, the donation receipt includes two portions, a first portion for the user to retain in his or her own tax records and a second portion which the user may tear off or otherwise separate, fill in with relevant information (such as a name and address) and mail to the charitable organization so the charitable organization can recognize and credit the source of the donation.

In systems of the described nature in which the configuration or programming information is downloaded from a central site to remote field units, certain types of configuration or data are believed to be particularly data-intensive, (in the sense that a relatively large amount of data must be downloaded) such as a graphics file, sound file, motion picture or animation file or the like. Accordingly, according to one embodiment of the invention, only certain predefined and limited-size types of graphics, sound files and the like are permitted. Such limitations not only make it possible to efficiently provide the described downloads but also result in a smaller memory or data storage requirement at each field unit.

Preferably, a central location, such as the central computer location 114, maintains information on how each of the field units are configured, including maintaining information regarding which organizations are shown on lists, or are "featured" on which field units and how each field unit is configured.

Preferably, the "featured charitable organization" screen presents only a limited number of charitable organizations. It is believed that systems which present a relatively large number of donation options to a user results in lowering the total amount of donations made. Preferably, the featured organizations represent a mix of types of charitable organizations (e.g. children's organizations, women's organizations, religious organizations and the like).

In the light of the above description, a number of advantages of the present invention can be seen. The present invention facilitates donation transactions while lowering personnel requirements and, it is believed, costs for obtaining, processing and depositing such transactions. The present systems provides a regional, national and/or worldwide system in which a person can readily make a donation to a charitable organization even though located in a distant geographic location or without appropriate donation forms or addresses and without the need to incur postage or telephone costs to make the donation.

A number of variations and modifications of the invention can be used. Although the invention has been described in connection with donations to a 401–3C charitable organization, it would be possible to configure a system which could accept donations to other types of organizations such as non-profit organizations, political organizations, political action committees and the like. Such a system, preferably, will provide appropriate notices on any printed receipts such as notices that the donation is not a tax deductible donation.

The flowchart of FIG. 5 illustrates operation of a second embodiment. The user places coins of varying denomination in to the external tray 505. Small foreign matter falls through perforations at the bottom of the tray 510 while large foreign matter is removed by the user 515. When the user is ready to begin using the machine, the user presses the "Go" button 520. Pressing the "Go" button activates the coin sorter, initializes the coin counter and activates a fan within a waste management chute 525. Next, the user lifts the edge of the hopper tray, dumping the coins down the entrance chute of the waste management system 528. As the coins go through the waste management system, certain waste, such as liquids, are removed 530. The coins are then counted and, in one embodiment, sorted 540. During this step, coins which do not meet the necessary physical criteria are rejected and returned to the user 535. As the coins are counted, the value of the coins is displayed on a monitor as well as the number of coins counted within each denomination 540. In one embodiment, manufacturers' coupons are dispensed 540. After all the coins are counted, the user is asked to either accept the value that has been determined and continue the transaction, or to reject the value and discontinue this transaction 545. In this embodiment, if the user decides to reject the stated value, then the coins are returned 550 and the transaction ends 595. In a related embodiment, the input and counting steps are similar but the user is not asked to accept or reject the counted value.

In the depicted embodiment, the user is asked whether they would like to donate, in whole or in part, the value of the coins to a charitable organization 553. If the user does not wish to donate to a charitable organization, then a cash voucher is issued 577 and the transaction ends 595. If the user wishes to donate to one or more charitable organizations, the user is asked to choose to which charitable organization or organizations they wish to donate 557, 560, 565, 570. If they do not wish to donate to any of the listed charities, then the transaction ends 595 and, in one embodiment, the coins are returned 573.

Other embodiments are also possible. In one embodiment, the user is given a choice to donate to a charitable organization, or not to donate, at the beginning of the operation, before coin-counting commences. In one embodiment, the user may donate all the value of the transaction, but does not have an option to donate only a portion of the transaction, or to donate different portions to different charitable organizations.

After choosing to which charity they wish to donate, the user is asked if they wish to donate the total value of the coins 580. If the user wishes to donate the total amount then a receipt is issued which states the amount and the charity 583. Preferably, the user is given an opportunity to donate to more than one charity, either the total amount or a percentage of the total amount and is given the opportunity to indicate what amounts or percentages are to go to each of the designated or selected charities. The CPU 290 records the amount donated and charity or charities 583 so that when the coins are removed from the field unit, the proper amounts can be deposited to the appropriate charity organizations. If the user selects to donate only a portion of the total amount, they then enter the amount donated 587. At this point, a receipt for the donated portion is issued, a cash voucher for the remainder of the total amount is issued, and the CPU records the amount donated and the charity for later disbursement of funds 590.

Although the present invention has been described by way of a preferred embodiment and certain variations and modifications, other variations and modifications can also be used, the invention being defined by the following claims:

What is claimed is:

1. A method comprising the steps of:

providing an apparatus configured to receive money from users and to verify an amount represented by said money, wherein said apparatus is coupled to one or more input devices;

allowing the user to choose to donate said amount of money to a charitable organization, using said input devices of said apparatus;

allowing the user to choose among different charitable organizations, using said input devices of said apparatus;

maintaining a record of the value to be donated;

maintaining a record of the charitable organization chosen; and automatically dispensing, from said apparatus, a donation receipt for the value donated to the charitable organization.

2. A method, as claimed in claim 1, wherein said apparatus is configured to receive and count a plurality of coins of arbitrary denomination.

3. A method, as claimed in claim 1, wherein said apparatus is configured to receive cash.

4. A method, as claimed in claim 1, wherein a code is associated with each of said plurality of charitable organizations and wherein said user may select a charitable organization by inputting said code.

5. A method, as claimed in claim 1, further comprising displaying, on a display screen indications of at least some of said charitable organizations.

6. A method, as claimed in claim 1, further comprising displaying, on a display screen, at least a first graphic associated with at least a first of said plurality of charitable organizations.

7. A method, as claimed in claim 1, further comprising outputting, from said apparatus, sounds associated with at least a first of said plurality of charitable organizations.

8. A method, as claimed in claim 1, further comprising providing a second apparatus configured to receive money from users and to verify an amount represented by said money, and coupling said first and second apparatus to a central computer by a communications device.

9. A method, as claimed in claim 8, further comprising transmitting from said first and second apparatus, information indicative of amounts of donations to charitable organizations made by users of said first and second apparatus.

10. A method, as claimed in claim 9, further comprising depositing amounts based on said amounts of donations to at least one of said plurality of charitable organizations using electronic funds transfer.

11. A method comprising the steps of:

receiving a plurality of coins of arbitrary denomination from users;

allowing the user to choose to donate to charitable organizations, in whole or in part, the value of said coins;

allowing the user to choose between different charitable organizations;

determining a total amount of said coins;

maintaining a record of the value to be donated;

maintaining a record of the charitable organization chosen;

dispensing a donation receipt for the value donated to the charitable organization.

12. The method of claim 11 further comprising the step of:

dispensing a cash voucher for the difference between the value of said coins and the value of said donation.

13. Apparatus comprising a computer-implemented funds verifier configured to receive money from users and to verify an amount represented by said money, wherein said funds verifier is coupled to one or more input devices;

allowing the user to choose to donate said amount of money to a charitable organization, using said input devices of said funds verifier;

allowing the user to choose among different charitable organizations, using said input devices of said funds verifier;

maintaining a record of the value to be donated;

maintaining a record of the charitable organization chosen; and automatically dispensing, from said funds verifier, a donation receipt for the value donated to the charitable organization.

14. An apparatus comprising:

coin-counting means for determining a total amount of said coins;

means for receiving a plurality of coins of arbitrary denomination from a user, said means for receiving including a first tray pivotable from a first holding position to a second delivery position for delivering said plurality of coins to said coin-counting means;

means, coupled to said means for receiving, for removing waste included among said plurality of coins;

means for allowing a user to donate, to a charitable organization, in whole or in part, the total amount of said coins;

means, coupled to said coin-counting means, for dispensing a cash voucher for a value related to said total amount;

wherein said means for receiving comprises a transport tray for conveying coins from said first tray toward said coin-counting means;

wherein said first tray is pivotable about an axis located between said first tray and said transport tray;

wherein said first tray has a bottom surface and wherein said bottom surface of said first tray, when in said first configuration, slopes downwardly at first angle, with respect to horizontal, in a direction away from said transport tray.

* * * * *